US008807610B2

(12) United States Patent
McCartor

(10) Patent No.: US 8,807,610 B2
(45) **Date of Patent: *Aug. 19, 2014**

(54) GARNISH PICK

(71) Applicant: Andrew McCartor, New York, NY (US)

(72) Inventor: Andrew McCartor, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/920,430

(22) Filed: Jun. 18, 2013

(65) Prior Publication Data

US 2013/0277994 A1 Oct. 24, 2013

Related U.S. Application Data

(63) Continuation of application No. 13/080,754, filed on Apr. 6, 2011, now Pat. No. 8,465,069.

(51) Int. Cl.
*A47G 21/00* (2006.01)
*A47J 43/28* (2006.01)

(52) U.S. Cl.
USPC ..... 294/61; D7/684

(58) Field of Classification Search
USPC ..... 294/61, 5.5; D7/300.2, 683, 684; 132/321, 329
See application file for complete search history.

(56) References Cited

U.S. PATENT DOCUMENTS

| | | | | | |
|---|---|---|---|---|---|
| 2,070,976 | A * | 2/1937 | Petersen | 294/61 |
| 2,925,087 | A * | 2/1960 | Kucher | 132/329 |
| D193,441 | S * | 8/1962 | Marsh | D7/684 |
| D195,870 | S * | 8/1963 | Ogg | D7/684 |
| D202,472 | S * | 10/1965 | Taylor | D7/684 |
| 3,722,457 | A * | 3/1973 | Hartinger | 116/321 |
| 3,772,809 | A * | 11/1973 | Schneller | 40/637 |
| D311,119 | S * | 10/1990 | LaBarbera | D7/684 |
| D413,051 | S * | 8/1999 | Torelli | D7/684 |
| 8,465,069 | B2 * | 6/2013 | McCartor | 294/61 |

* cited by examiner

*Primary Examiner* — Dean Kramer
(74) *Attorney, Agent, or Firm* — Michael J. Andri

(57) ABSTRACT

A garnish pick for food and/or beverages is disclosed. In at least some embodiments, the garnish pick includes a plurality of appendages that form skewering shafts for skewering garnishes. In at least some embodiments, at least one appendage of the garnish pick forms a hook for securing the garnish pick to a food or beverage container. In at least some embodiments, the garnish pick and its associated appendages may be shaped to simulate the appearance of organisms or portions thereof. As one example, the garnish pick may simulate the appearance of a branch of a tree or an antler of an animal.

16 Claims, 12 Drawing Sheets

GARNISH PICK

CROSS-REFERENCE TO RELATED APPLICATION

The present application claims priority to and is a continuation of U.S. patent application Ser. No. 13/080,754, titled GARNISH PICK, filed Apr. 6, 2011, which is a Non-Provisional of and claims priority to U.S. Provisional Patent Application Ser. No. 61/321,291, titled GARNISH PICK, filed Apr. 6, 2010, the entire contents of these applications are incorporated herein by reference in their entirety for all purposes.

BACKGROUND

A variety of garnishes may be used to add flavor and decoration to foods and beverages. For example, beverages including alcoholic cocktails may be served with a garnish of vegetables or fruits that are at least partially submerged in the beverage. Such garnishes are often served on a garnish pick in order to secure the garnish and enable the garnish to be more easily removed from the beverage.

SUMMARY

A garnish pick is disclosed that includes one or more appendages. In at least some embodiments, at least some of the appendages may comprise skewering shafts that are tapered and/or sharpened at an outer tip of the appendage for skewering and holding a garnish. Such appendages may project from a main shaft of the garnish pick at a variety of angles and/or orientations. In at least some embodiments, the angles and/or orientations at which such appendages project from a main shaft may be defined so that the garnish pick simulates the appearance of an organism or a portion thereof, such as a branch of a tree or an antler of an animal. In at least some embodiments, at least some of the appendages may form a hook for securing the garnish pick to a food or beverage container, such as a rim of a serving glass. An appendage that forms a hook may be used to prevent the garnish pick from becoming further submerged or entirely submerged into foods or beverages in a container. Accordingly, an appendage of the garnish pick may serve either as a shaft with which to skewer and hold a garnish, or as a hook for accepting a rim of a food or beverage container. At least some embodiments, the garnish pick may have two or more appendages, wherein at least one of the appendages may serve as a hook, while at least one of the other appendages may serve as a skewering shaft.

BRIEF DESCRIPTION OF DRAWINGS

Non-limiting and non-exhaustive aspects are described with reference to the following figures, wherein like reference numerals refer to like parts throughout the various figures unless otherwise specified.

DETAILED DESCRIPTION

Conventional cocktail garnish picks are typically thin, straight, cylindrical pieces of wood, metal or plastic, with a sharpened end. While the typical garnish pick is formed by a single straight shaft to skewer and hold a garnish, such a design allows the entire pick to occasionally slide below the line of the liquid, potentially submerging the garnish pick. This is inconvenient for people that prefer to eat the garnish while drinking the cocktail, because it may require the person to dip his or her fingers into the cocktail to retrieve the pick and garnish, and which may be perceived as unsanitary and unappealing. In addition, when more than one garnish is skewered and stacked onto a single shaft, it may be difficult for a person to remove each garnish from the garnish pick without using his or her fingers. If, for example, three olives are stacked on a single shaft, the olive next to the sharp end of the shaft can be easily pulled off by a person using their teeth, while removing a second or third olive may require the person to use his or her fingers to remove the second or third olives because of the increased distance of the second and third olives from the sharp end of shaft.

Figure 1:
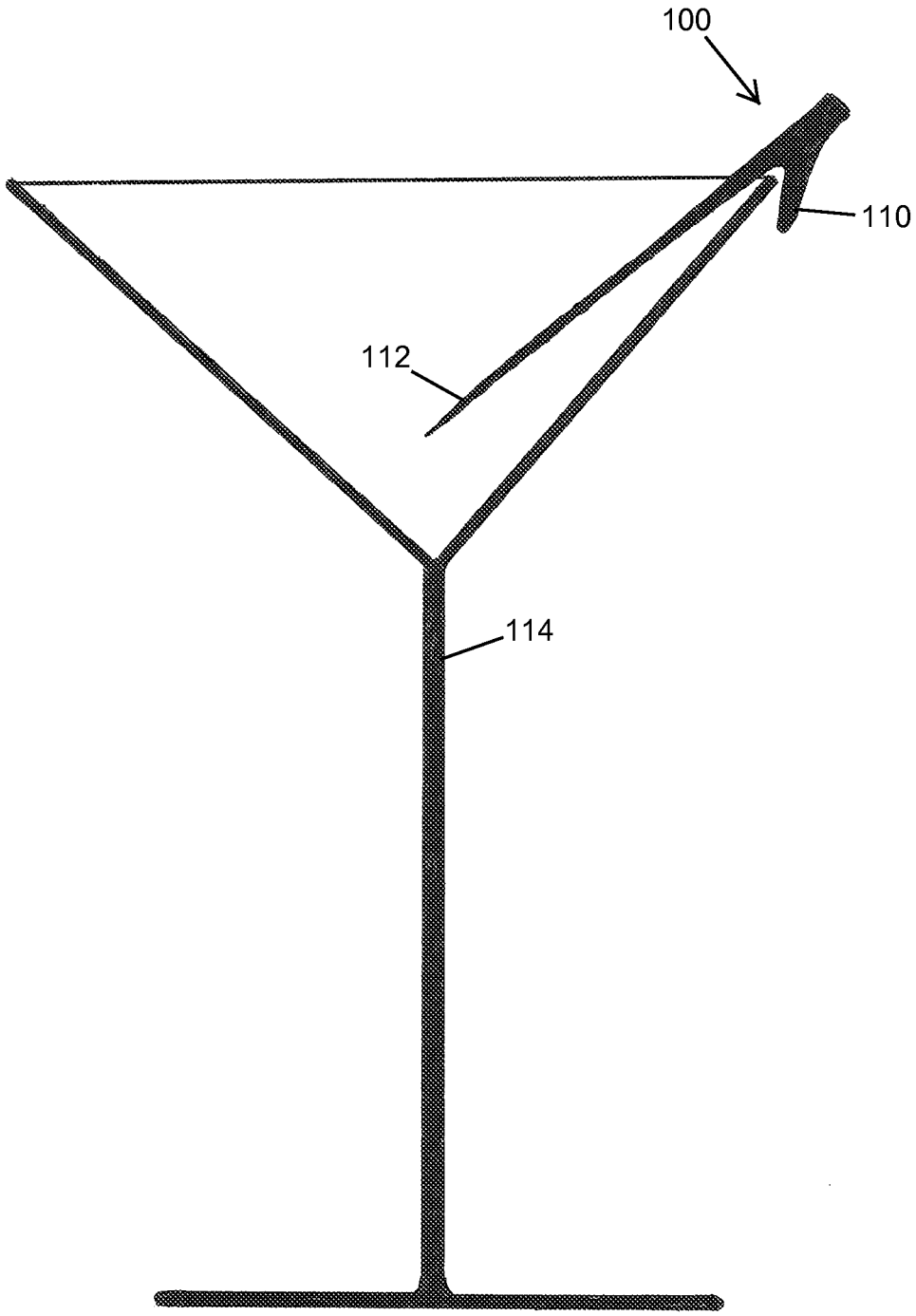
FIG. 1 shows an example garnish pick, according to one embodiment, in a martini glass, in which the pick has a straight main shaft and a single appendage serving as a hook for the rim of the glass.

Referring now to FIG. 1, an example garnish pick 100 is shown according to one embodiment in an example usage environment of a martini glass 114. Specifically, FIG. 1 shows how an appendage 110 of the garnish pick may exit a main shaft 112 angling toward the skewering end of the garnish pick, and hook or otherwise secure the pick to the rim of a glass, preventing the garnish pick from sliding into the cocktail glass, or completely or further submerging the garnish pick into a beverage. In this embodiment, the main shaft 112 also serves as a skewering shaft for holding a garnish.

Figure 2:
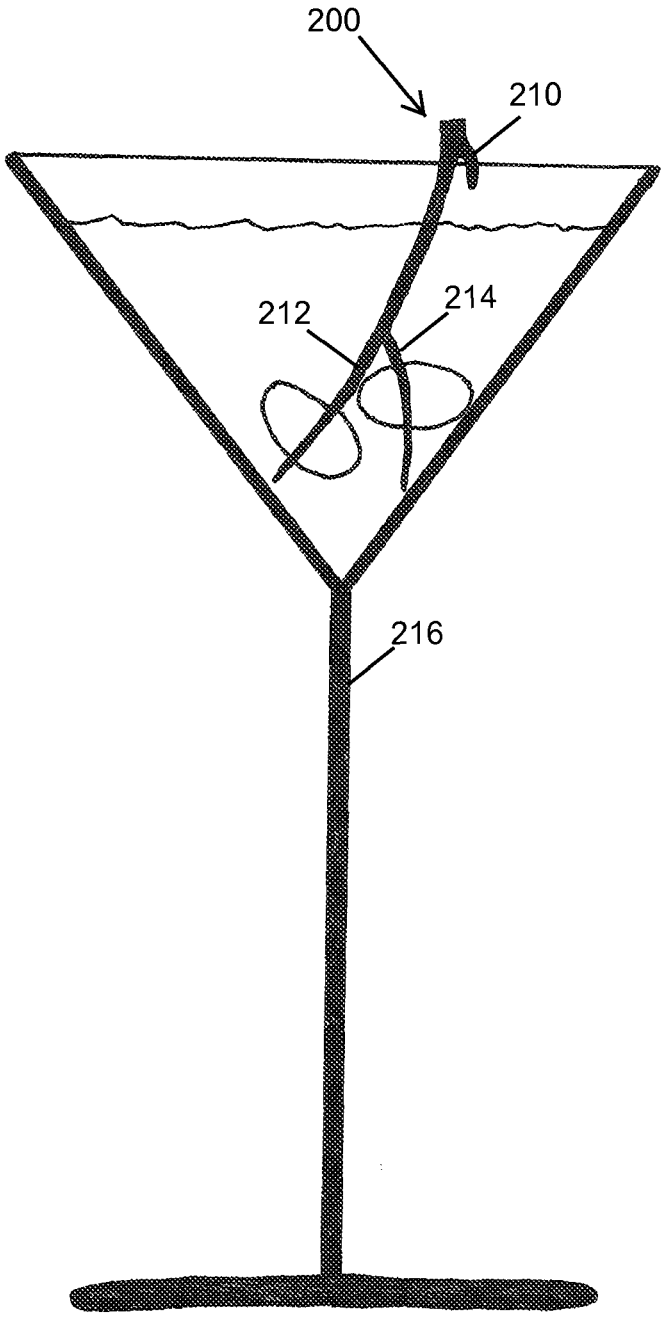
FIG. 2 shows an example garnish pick, according to one embodiment, situated in a martini glass, in which the pick has a curving main shaft and two appendages. One appendage serves as a hook, and the other as a skewering shaft.

FIG. 2 shows a garnish pick 200 in an example usage environment of a martini glass 216. In this example embodiment, garnish pick 200 includes three appendages, wherein a first appendage 210 may serve as a hook, and a second appendage 212 and a third appendage 214 may serve as skewering shafts. FIG. 2 also shows how garnishes, e.g., in this case olives, can be held on the garnish pick, for example, by appendages 212 and 214.

Figure 3:
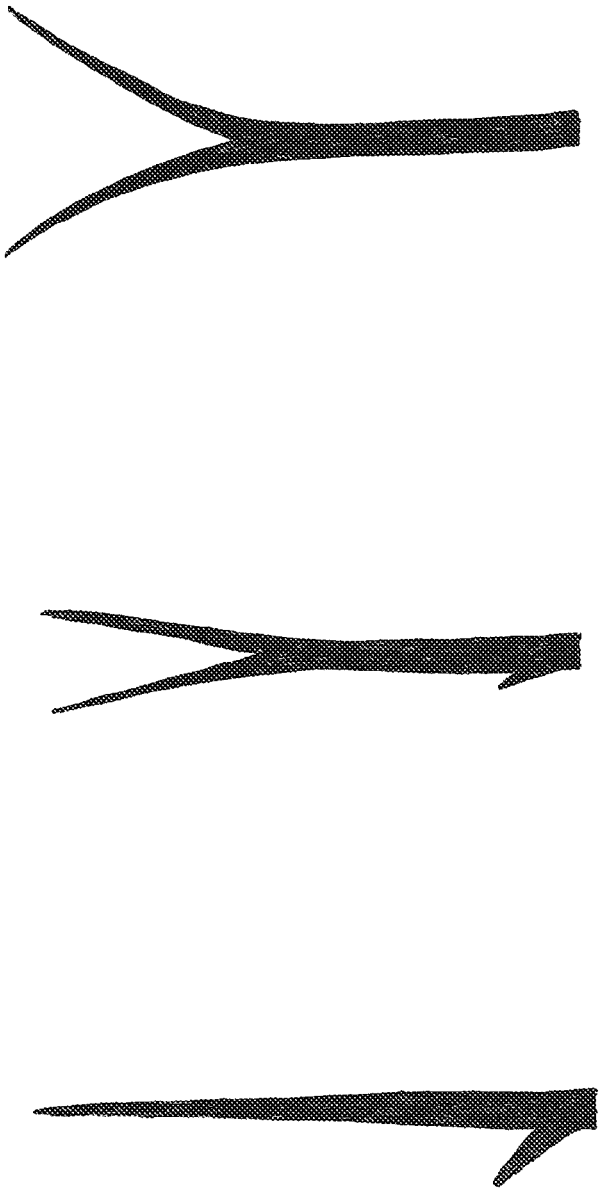
FIG. 3 shows an example garnish pick, according to one embodiment, in which the main shaft is forked, forming two skewering shafts. In this figure a single pick shown in three different views that are rotated 45 degrees relative to each other shows the relative position of the hook.
Figure 4:
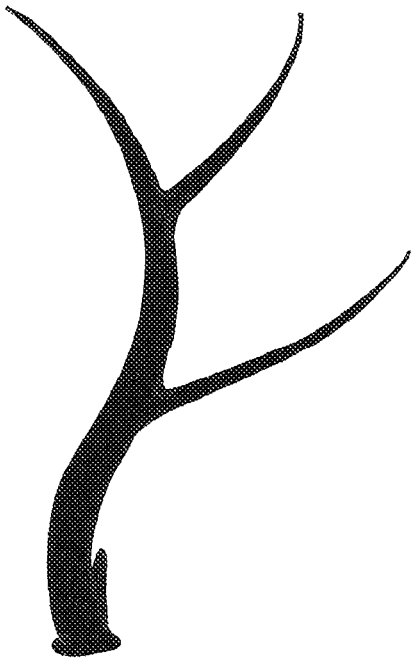
FIG. 4 shows an example garnish pick, according to one embodiment, in which three appendages connect to a curved shaft resembling, for example, a deer's antler. One appendage serves as a hook and the other two as skewering shafts.
Figure 5:
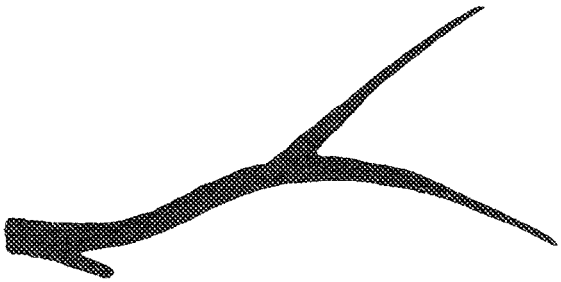
FIG. 5 shows an example garnish pick, according to one embodiment, in which two appendages connect to a curved shaft, one of which serves as a hook and the other as a skewering shaft.
Figure 6:
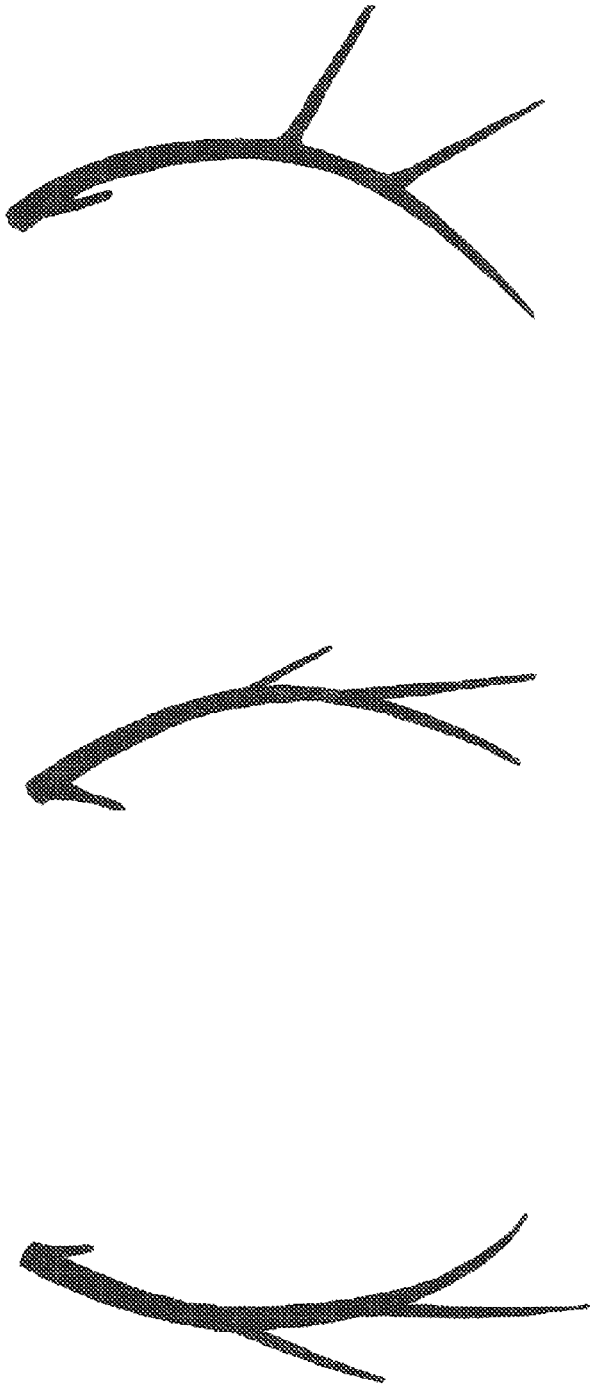
FIG. 6 shows an example garnish pick, according to one embodiment, in which the pick is rotated approximately 90 degrees relative to each other in each figure, and in which three appendages connect to a curved main shaft, one of which serves as a hook and the others as skewering shafts.
Figure 7:
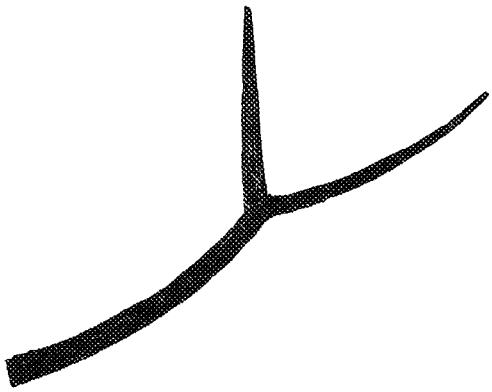
FIG. 7 shows an example garnish pick, according to one embodiment, in which there is no hooking appendage and in which main shaft forks, forming two skewering appendages.
Figure 8:
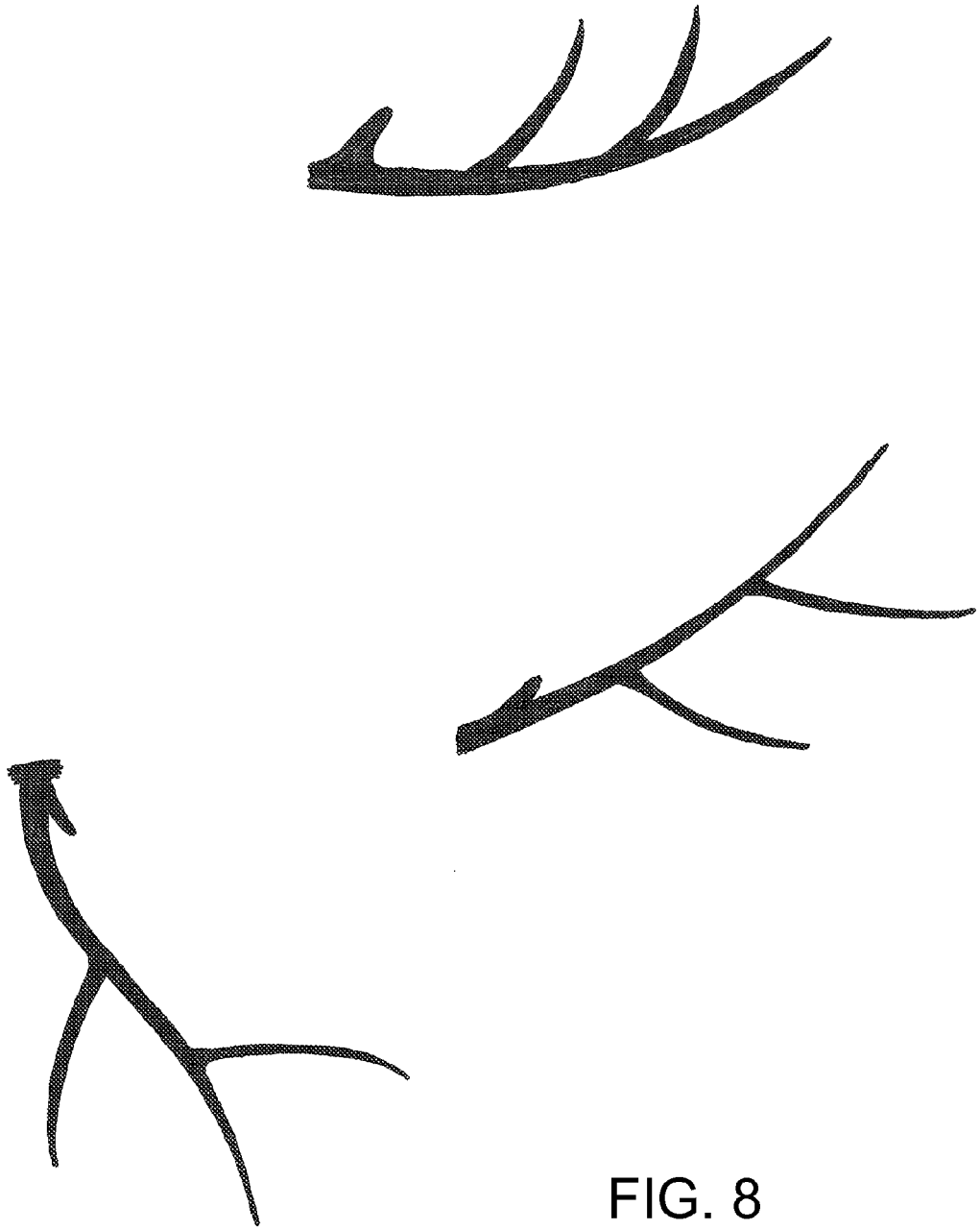
FIG. 8 shows another example garnish pick according to one embodiment.

FIG. 3 shows a single embodiment of a garnish pick depicted at different angles rotated 45 degrees relative to each other. FIG. 3 shows how multiple appendages can exit the primary shaft, one serving as a hook for the rim of the glass, while the others serve as skewers.

Figure 9:
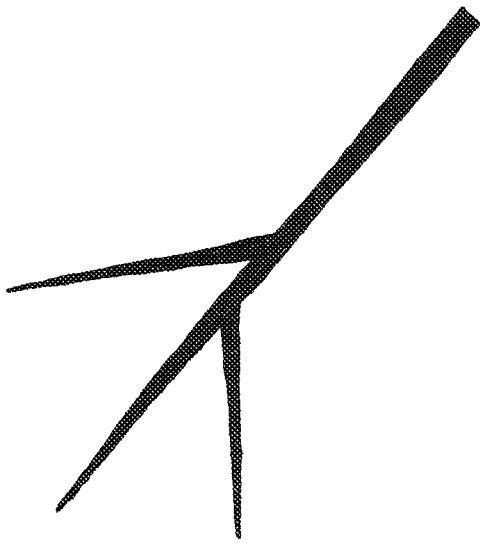
FIG. 9 shows an example garnish pick, according to one embodiment, in which two appendages emerge from opposite or opposing sides of a straight shaft, forming three skewing shafts.

In further detail, still referring to FIG. 1, FIG. 2 and FIG. 3, the garnish pick may be of a total length that is approximately equal to the distance from the rim of a martini glass to the center of the bottom of the glass. However, other suitable lengths may be used. Because martini glasses come in a variety of shapes and sizes, this distance may vary. In at least one non-limiting example, a total length of the garish pick does not exceed five inches and is not less than two inches in length. FIG. 9 further shows how an appendage for serving as a hook may be omitted from the garnish pick in at least some embodiments.

In at least some embodiments, a total diameter or width of the garnish pick may be at its largest is 15 cm or less, with the diameter or width diminishing toward the sharp end of the skewering shafts. The portions of the garnish pick that are adapted to hold a garnish may have a diameter sufficiently small such that a garnish (e.g., an olive or other suitable garnish item) can slide onto that portion of the garnish pick without undue difficulty and/or without splitting or damaging the garnish.

Figure 10:
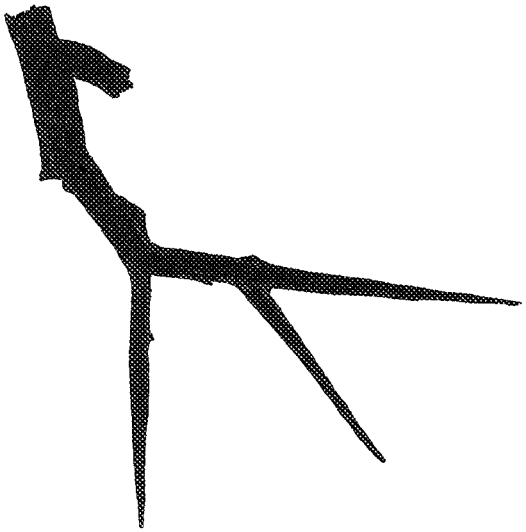
FIG. 10 shows an example garnish pick, according to one embodiment, in which three appendages and the main shaft are contoured to resemble, for example, a twig or branch of a tree or plant.
Figure 11:
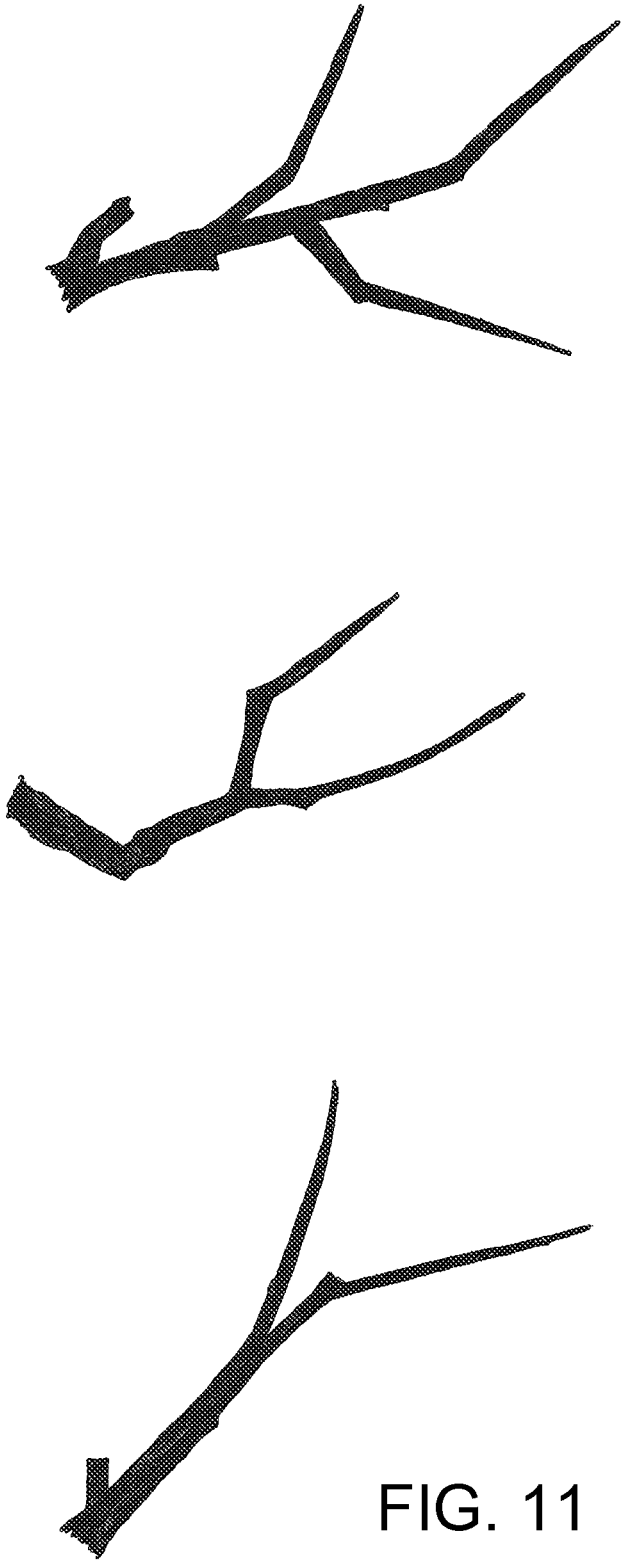
FIG. 11 shows three example garnish picks, according to three embodiments, which are contoured to resemble twigs or branches.

In at least some embodiments, the main shaft and/or appendages may curve, have abrupt bends, or be curved along at least a portion of its axis. The main shaft and/or appendages may have bumps, ridges, craters, or be otherwise unsmooth or rough (e.g., as shown by the non-limiting examples of FIGS. 10 and 11). The main shaft and/or appendages may have circular cross-sections, convolute cross-sections, ovular cross-sections, non-circular cross-sections, square or rectangular cross-sections, pentagonal cross-sections, hexagonal cross-sections, or irregularly shaped cross-sections, among other shapes. The main shaft and/or appendages may have twists and/or cork screws that may be expanding or narrowing (e.g., at a radius of curvature) along a longitudinal axis of the main shaft or appendage (e.g., non-regular corkscrew or twist). Such twists and/or corkscrews may be less than a full rotation, between one full rotation and two full rotations, greater than two full rotations, or comprise an even greater number of rotations. In at least some embodiments, one or more of the appendage may have smaller appendages (e.g., sub-appendages) that branch from them.

The construction details of the garnish picks disclosed herein may be that such garnish picks may be made of wood or of any other sufficiently rigid, flexible, and/or strong material such as plastic, rubber, metal, glass, ceramic, and the like depending on implementation. Further, the various components of the garnish pick can be made of different materials. For example, a garnish pick may comprise two or more materials. For example, the garnish pick may comprise a first material (e.g., metal or plastic) having an outer coating comprising a second material (e.g., rubber, plastic or paint).

The advantages of the disclosed embodiments may include, without limitation, that the garnish pick can be hooked to the side of a glass, preventing the pick from becoming completely or further submerged in a beverage, and can provide additional shafts (e.g., appendages) on which to hold garnishes. Such embodiments may also eliminate the need to retrieve the pick out of the beverage or beverage container (e.g., with fingers) and may make it easier to eat garnishes off of the pick (e.g., without using fingers to touch the garnishes).

As previously described, a garnish pick is provided that may be used to hold garnishes with one or more appendages emerging from a main shaft, angled toward a sharp end of the main shaft, that are used either to hook the pick to the rim of the glass or to skewer garnishes, or both. In embodiments where the garnish pick comprises a plurality of appendages, such appendages may project from a main shaft of the garnish pick at the same or different angles relative to each other along a longitudinal axis and/or an orthogonal axis of the main shaft. For example, a first appendage may project from the main shaft at a greater angle relative to a longitudinal axis of the main shaft than a second appendage and/or a third appendage. Accordingly, the garnish pick may comprise two, three, four, five, or more appendages that each project from a main shaft or other base appendage (e.g., where such appendages comprise sub-appendages) at different angles relative to each other as measured relative to a longitudinal axis of the main shaft or other base appendage. As another example, a first appendage may project from the main shaft or other base appendage (e.g., for sub-appendages) at a 2 o'clock position when viewed in a plane that is orthogonal to the longitudinal axis of the main shaft or base appendage, while a second appendage may project from the main shaft at a 6 o'clock position, and/or a third appendage may project from the main shaft at an 8 o'clock position. Such examples are provided for descriptive purposes and should not be considered limiting.

Figure 12:
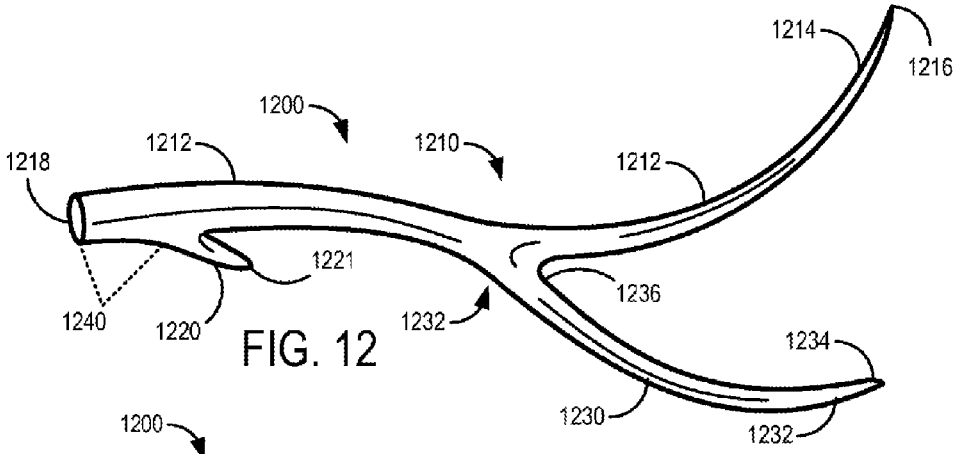
FIG. 12 shows another example garnish pick according to one embodiment.
Figure 13:
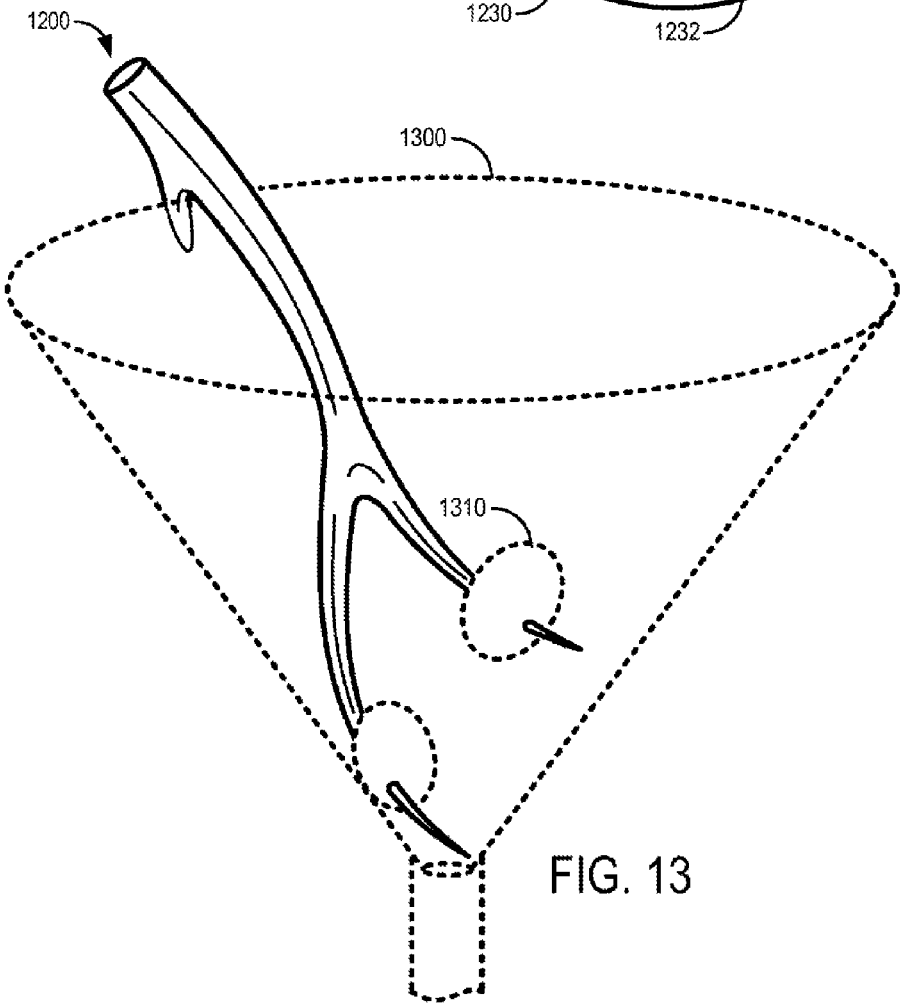
FIG. 13 shows the example garnish pick of FIG. 12 in an example use environment of a beverage container.

FIG. 12 shows another example garnish pick 1200 according to one embodiment. FIG. 13 shows the example garnish pick 1200 of FIG. 12 in an example use environment of a beverage container. Garnish pick 1200 includes a pick body 1210. The pick body may include a first elongate body portion 1212 having a first end 1214 forming a first tapered skewer 1216 and having a second end 1218 forming a hook 1220. The pick body may include a second elongate body portion 1230 branching outward from the first elongate body portion at an intermediate location 1232 between first end 1214 and second end 1218. The second elongate body portion may have a distal end 1232 forming a second tapered skewer 1234. In at least some embodiments, first elongate body portion 1212 may taper from second end 1218 toward first end 1214, and second elongate body portion 1230 may taper from a base end 1236 toward distal end 1232 of the second elongate body portion.

In at least some embodiments, a cross-sectional area of the second elongate body portion at the base end is smaller than a cross-sectional area of the first elongate body portion at the intermediate location where the second elongate body portion branches outward from the first elongate body portion. In at least some embodiments, the first elongate body portion may be curved along a length of the first elongate body portion between the first end and the second end. The curvature of the first elongate body portion may vary along at least a portion of the length of the first elongate body portion between the first end and the second end. In at least some embodiments, the first elongate body portion may be curved in one, two, or more orthogonal planes along at least a portion of the length of the first elongate body portion between the first end and the second end. The second elongate body portion may be curved in one, two, or more orthogonal planes along at least a portion of a length of the second elongate body portion between a base end and the distal end. The first and second elongate body portions may each have a different curvature. A length of the second elongate body portion may be less than, greater than, or equal to a length of the first elongate body portion between the intermediate location and the first end of the first elongate body portion.

In at least some embodiments, the pick body may further include a third elongate body portion branching outward from the first elongate body portion at another intermediate location between the first end of the first elongate body portion and the intermediate location where the second elongate body branches outward from the first elongate body. The third elongate body portion may have a distal end forming a third tapered skewer. The third elongate body portion may be curved in one, two, or more orthogonal planes along at least a portion of the length of the third elongate body portion between a base end and a distal end of the third elongate body portion. The first, second, and third elongate body portions may each have different curvature a, and may each have similar or different lengths of one or more other elongate body portions of the garnish pick.

In at least some embodiments, hook 1220 formed at second end 1218 of first elongate body portion 1212 may branch outward from first elongate body portion 1212 at a location that is offset 1240 from second end 1218 of first elongate body portion 1212. The hook may taper along its length toward a distal end 1221 of the hook. The hook formed at the second end of the first elongate body portion may be adapted to receive a rim of a beverage container 1300 (e.g., as depicted in FIG. 13). In at least some embodiments, a remainder of the pick body including at least the first and second elongate portions may be sized to fit substantially within a beverage container when or if the rim of the beverage container is received by the hook as depicted in FIG. 13, for example. FIG. 13 shows garnish pick 1200 with example garnish 1310.

In at least some embodiments, the pick body may be asymmetric about any plane (e.g., any or all reference planes) passing through the garnish pick. The pick body may comprise a core formed from a first material and an outer coating substantially surrounding the core, the outer coating formed from a second material that is different from the first material.

As yet another alternative description of an example garnish pick, a pick body of the garnish pick may include a stem portion (e.g., the portion of pick body 1212 between 1218 and 1232), a first elongate body portion (e.g., the portion of pick body 1212 between 1214 and 1232) branching from the stem portion, and a second elongate body portion (e.g., elongate body portion 1230 branching from the stem portion or the first elongate body portion. The first elongate body portion may taper from a base end toward a distal end of the first elongate body portion to form a first tapered skewer, and the second elongate body portion may taper from a base end toward a distal end of the second elongate body portion to form a second tapered skewer. The stem portion may form a hook as previously described.

While the foregoing written description enables one of ordinary skill to make and use what is considered presently to be the best mode thereof, those of ordinary skill will understand and appreciate the existence of variations, combinations, and equivalents of the specific embodiments, methods, and examples disclosed herein. Such disclosure and/or claimed subject matter should therefore not be limited by the above described embodiments, methods, and examples.

The invention claimed is:

1. A garnish pick, comprising:

a pick body including:

a first elongate body portion having a first end forming a first tapered skewer and having a second end forming a hook, wherein the first elongate body portion is curved along a length of the first elongate body portion between the first end and the second end, and wherein the first elongate body portion is curved in at least two orthogonal planes along the length of the first elongate body portion between the first end and the second end; and a second elongate body portion branching outward from the first elongate body portion at an intermediate location between the first end and the second end, the second elongate body portion having a distal end forming a second tapered skewer;

wherein the pick body is asymmetric about all planes passing through the garnish pick.

2. The garnish pick of claim 1, wherein the first elongate body portion tapers from the second end toward the first end, and wherein the second elongate body portion tapers from a base end toward the distal end of the second elongate body portion.

3. The garnish pick of claim 2, wherein a cross-sectional area of the second elongate body portion at the base end is smaller than a cross-sectional area of the first elongate body portion at the intermediate location where the second elongate body portion branches outward from the first elongate body portion.

4. The garnish pick of claim 1, wherein curvature of the first elongate body portion varies along the length of the first elongate body portion between the first end and the second end.

5. The garnish pick of claim 1, wherein the second elongate body portion is curved along a length of the second elongate body portion between a base end and the distal end.

6. The garnish pick of claim 1, the pick body further including:

a third elongate body portion branching outward from the first elongate body portion at another intermediate location between the first end of the first elongate body portion and the intermediate location where the second elongate body branches outward from the first elongate body, the third elongate body portion having a distal end forming a third tapered skewer.

7. The garnish pick of claim 1, wherein a length of second elongate body portion is less than a length of the first elongate body portion between the intermediate location and the first end of the first elongate body portion.

8. The garnish pick of claim 1, wherein the hook formed at the second end of the first elongate body portion branches outward from the first elongate body portion at a location that is offset from the second end of the first elongate body portion.

9. The garnish pick of claim 1, wherein the hook tapers along its length toward a distal end of the hook.

10. The garnish pick of claim 1, wherein the hook formed at the second end of the first elongate body portion is adapted to receive a rim of a beverage container.

11. The garnish pick of claim 1, wherein the pick body comprises a core formed from a first material and an outer coating substantially surrounding the core, the outer coating formed from a second material that is different from the first material.

12. A garnish pick, comprising:

a pick body including:

a first elongate body portion having a first end forming a first tapered skewer;

a second elongate body portion branching outward from the first elongate body portion at an intermediate location between the first end and a second end of the first elongate body portion, the second elongate body portion having a distal end forming a second tapered skewer; and a third elongate body portion branching outward from the first elongate body portion at another intermediate location between the first end of the first elongate body portion and the intermediate location where the second elongate body branches outward from the first elongate body, the third elongate body portion having a distal end forming a third tapered skewer;

wherein the first elongate body portion tapers from the second end toward the first end, wherein the second and third elongate body portions each taper toward their respective distal ends;

wherein the first, second, and third elongate body portions are each curved along their respective lengths, each of the first, second, and third elongate body portions have different curvatures;

wherein the pick body is asymmetric about every plane passing through the garnish pick.

13. The garnish pick of claim 12, wherein the first elongate body portion has a second end forming a hook that is adapted to receive a rim of a beverage container, and wherein the hook tapers along its length toward a distal end of the hook.

14. A garnish pick, comprising:

a pick body including:

a first elongate body portion having a first end forming a first tapered skewer and having a second end forming a hook;

a second elongate body portion branching outward from the first elongate body portion at an intermediate location between the first end and the second end, the second elongate body portion having a distal end forming a second tapered skewer; and a third elongate body portion branching outward from the first elongate body portion at another intermediate location between the first end of the first elongate body portion and the intermediate location where the second elongate body branches outward from the first elongate body, the third elongate body portion having a distal end forming a third tapered skewer;

wherein the pick body is asymmetric about all planes passing through the garnish pick.

15. The garnish pick of claim 14, wherein the pick body is formed from one or more of the following materials: metal, plastic, rubber, ceramic, glass.

16. The garnish pick of claim 14, wherein the hook is adapted to receive a rim of a beverage container, and wherein a remainder of the pick body including at least the first and second elongate portions is sized to fit substantially within the beverage container when the rim of the beverage container is received by the hook.

* * * * *